US011198584B2

(12) United States Patent
Behrens

(10) Patent No.: US 11,198,584 B2
(45) Date of Patent: Dec. 14, 2021

(54) VARIABLE SIZE COILED TUBING COUNTER

(71) Applicant: PREMIER COIL SOLUTIONS, INC., Waller, TX (US)

(72) Inventor: Randall Dean Behrens, Sealy, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 59 days.

(21) Appl. No.: 16/737,659

(22) Filed: Jan. 8, 2020

(65) Prior Publication Data

US 2020/0216285 A1 Jul. 9, 2020

Related U.S. Application Data

(60) Provisional application No. 62/790,370, filed on Jan. 9, 2019.

(51) Int. Cl.
*E21B 19/22* (2006.01)
*B65H 61/00* (2006.01)

(52) U.S. Cl.
CPC ..... *B65H 61/00* (2013.01); *E21B 19/22* (2013.01); *B65H 2601/422* (2013.01)

(58) Field of Classification Search
CPC ..... E21B 19/22; B65H 61/00
See application file for complete search history.

(56) References Cited

U.S. PATENT DOCUMENTS

| | | | | |
|---|---|---|---|---|
| 2,591,615 A * | 4/1952 | Saff | G01B 5/043 33/744 |
| 4,457,071 A * | 7/1984 | Alphonso | G01B 5/043 33/778 |
| 4,570,348 A * | 2/1986 | Amsler | G01B 7/046 33/734 |
| 7,377,051 B2 * | 5/2008 | Morris | E21B 19/22 33/734 |

FOREIGN PATENT DOCUMENTS

| | | |
|---|---|---|
| CN | 207036007 U * | 2/2018 |
| CN | 207363646 U * | 5/2018 |

* cited by examiner

*Primary Examiner* — Matthew R Buck
(74) *Attorney, Agent, or Firm* — Gregory L. Porter; Hunton Andrews Kurth LLP

(57) ABSTRACT

A variable sized coiled tubing counter is described herein. The variable sized coiled tubing counter includes a plurality of rollers. At least one roller is a floating roller which is allowed to travel and may be connected to a tension assembly. The variable sized tubing counter typically includes a counter which is rotationally connected to a floating counting roller using a somewhat flexible axle. As coiled tubing passes through the tubing counter, the length of tubing is determined based on the number of rotations of the counting roller. The use of floating, tensioned rollers allows the disclosed tubing counter to be utilized with multiple diameters of coiled tubing without significant adjustment to the tubing counter or changing components of the tubing counter.

14 Claims, 7 Drawing Sheets

VARIABLE SIZE COILED TUBING COUNTER

RELATED APPLICATIONS

This application claims priority to U.S. Application No. 62/790,370 filed Jan. 9, 2019 which application is incorporated by reference herein.

FIELD OF INVENTION

This invention relates to a system and method of measuring, viewing, and recording the footage of coiled tubing deployed or retrieved from a coiled tubing string; namely, the methodology of operation and adjustment of said counting device and operations using an automatic adjusting counter for varying tubing diameters used in the coiled tubing industry.

BACKGROUND

In the oil and gas industry, coiled tubing refers to a long continuous metal pipe, generally about 1 to 3.25 inches in diameter which is typically supplied using a reel. Coiled tubing may be used for interventions in oil and gas wells and may also be used as production tubing. Previous to the introduction of coiled tubing, wirelining was used to complete similar operations. Common applications of coiled tubing include deliquification and the disbursement of fluids to a specific location in a well, as well as circulation, pumping, logging, perforating, production, etc.

One complication typically associated with the use of coiled tubing is the need to measure the length of coiled tubing that has been dispensed into a well. Unlike jointed piping, where individual pipe segments of a known length may be tallied, the continuous nature of coiled tubing requires direct measurement of the length of the pipe down the well.

Traditional coiled tubing counters are a single roller placed along the tubing with a built in counter which is mounted in a stationary position. As coiled tubing passes along the roller, the tubing causes the roller to rotate. A mechanical arrangement translates the rotation of the roller with a given circumference into a reading of the length of coiled tubing that has passed through the counter. This presents a problem when the tubing moves or vibrates, which causes the roller to lose contact with the tubing. This disturbs the relationship between roller rotations and the length of tubing that has passed, causing the traditional counter to produce an inaccurate reading.

Traditional coiled tubing counters are generally configured to work with a particular diameter of coiled tubing. In order to utilize a different diameter of coiled tubing, an operator typically has to change the rollers of the counter. The rollers configured for specific diameters of coiled tubing typically have specific profiles. Sometimes a counter may include generic V-rollers to accommodate different diameters, however, these generic V-rollers may also have to be changed in order to meet a new circumference formula and produce an accurate reading of tubing length. This system required coiled tubing crews to retain multiple different configurations of components for the various diameters of coiled tubing they worked with. If these components are mixed or improperly organized, the counter will not produce accurate readings.

Previous solutions to these issues involved relocating rollers in different mounting slots along the upper and lower halves of a counter when different diameters of tubing were used. This typically requires a significant amount of time and effort. In some cases this also created a safety hazard as tubing counters are often located high above the ground.

Most counters transmit the revolutions of a roller to a mechanical counter using a metal axle. This arrangement lacks the ability to absorb vibration or allow travel of the rollers while maintaining a reliable rotating engagement. As coiled tubing counters are generally used in harsh environments and may be exposed to frequent and severe vibration, the use of a metal axle may produce inaccurate readings over time.

What is needed is a variable sized coiled tubing counter which does not require changing rollers or configurations in order to operate with multiple diameters of coiled tubing.

SUMMARY OF THE INVENTION

A variable sized coiled tubing counter is disclosed. Disclosed embodiments allow the rollers of the tubing counter to adjust to a spectrum of tubing diameters with little to no adjustment of the counter device. In some embodiments different diameters of tubing may be utilized without changing, swapping, or replacing rollers, or adjusting the configuration of components within the tubing counter.

In one aspect, embodiments disclosed herein relate to a system for counting the length of coiled tubing that has passed through a tubing counter, wherein the system allows rollers to adjust to a spectrum of tubing diameters without changing rollers or configuration. The system includes rollers that are under tension during operation and are operably linked to a counter and/or display. Disclosed embodiments do not require special tools in order to be used with multiple diameters of coiled tubing.

In another aspect, embodiments disclosed herein relate to the operation of a coiled tubing counter, the operation comprising caging the tensioned rollers so that the upper half of the tubing counter may be safely unlocked from the lower half and hinged open thereby allowing access to the interior of the tubing counter and allowing coiled tubing to be inserted, replaced, and/or removed from within the tubing counter. It will be understood that the term "caging" refers to temporarily restricting the movement of a component, such as, for example, temporarily restricting the movement of a tensioned roller.

BRIEF DESCRIPTION OF THE FIGURES

Exemplary embodiments of the disclosed invention are illustrated in the accompanying figures.

DETAILED DESCRIPTION

In the following description, certain details are set forth such as specific quantities, sizes, arrangements, configurations, components, etc., so as to provide a thorough understanding of the present embodiments disclosed herein. However, it will be evident to those of ordinary skill in the art that the present disclosure may be practiced without such specific details. In many cases, details concerning such considerations and the like have been omitted as such details are not necessary to obtain a complete understanding of the present disclosure and are within the skills of persons of ordinary skill in the relevant art.

Figure 1:
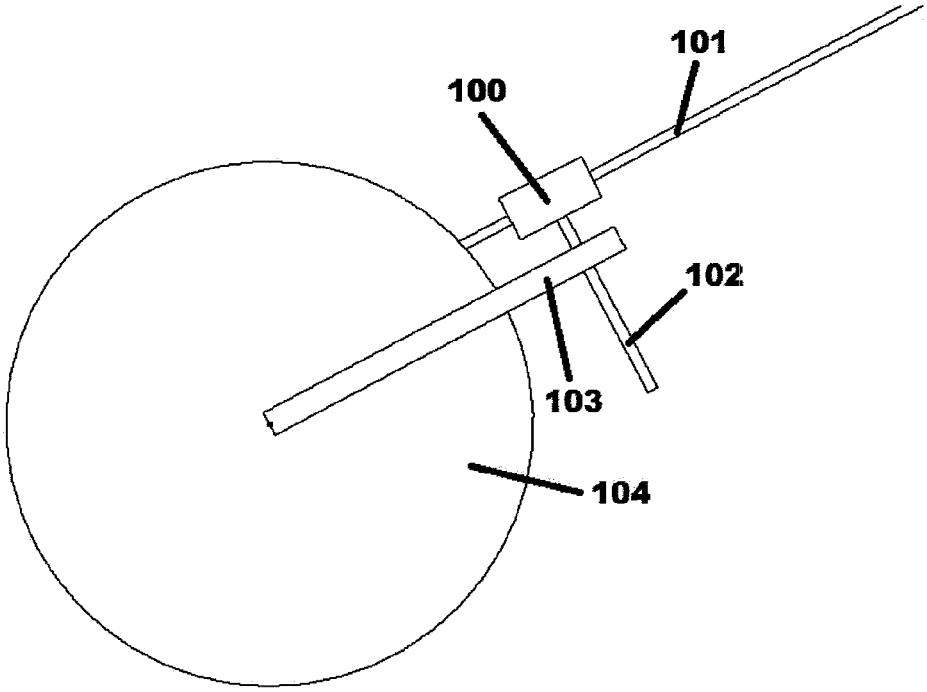
FIG. 1 illustrates a schematic of a potential coiled tubing deployment.

As shown in FIG. 1, in typical operations, coiled tubing (101) is fed from a tubing reel (104) through a coiled tubing counter (100) which counts the amount of tubing deployed into the wellhead. The tubing counter may be supported by a telescoping rod (102) that automatically adjusts the height of the tubing counter (100) by force from the height of the levelwind arm (103). The levelwind arm may be controlled by an operator. The levelwind arm (103) may be adjusted to provide a precise operating angle in which the tubing is deployed into a device called an injector, that forces the tubing into the wellhead. The injector is normally on a stack of equipment called a Blow-Out Preventer (BOP) that causes the injector to be positioned about 50-200 feet above a wellhead. The tubing reel (104) is often mounted on a trailer, skid, or truck that provides mobility for the coiled tubing unit to be moved from jobsite to jobsite.

Figure 2:
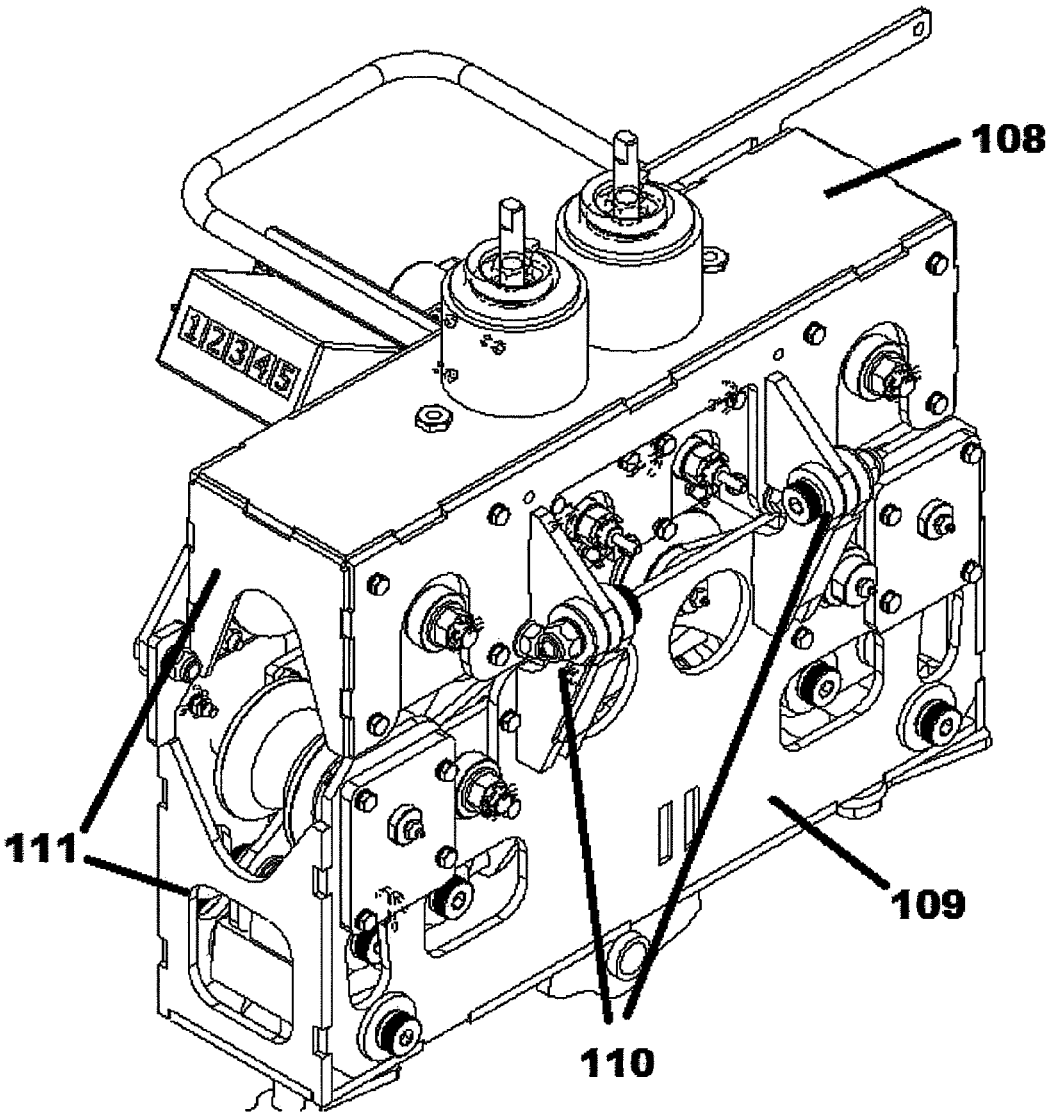
FIG. 2 illustrates an embodiment of variable sized coiled tubing counter.

As shown in FIG. 2, embodiments of the disclosed variable diameter coiled tubing counter (111) may be divided into two halves, an upper half (108) and a lower half (109), and generally have hinges (110) to allow for opening and closing of the device. In operation, the upper half may be locked to the lower half. In order to insert, replace, or remove tubing from the tubing counter, the top half may be flipped open at the hinges, thereby exposing the interior of the tubing counter and allowing access to the tubing and/or throughway which runs through the tubing counter.

Once the tubing counter has been closed around a section of coiled tubing, floating rollers (114) are brought into tensioned contact with the tubing. The tensioned floating rollers may be operably connected to a mechanical or digital counter which may be designed to communicate and/or display the length of coiled tubing inserted or removed from a well. In some embodiments, the roller in communication with a counter may be a fixed guide roller rather than a floating roller. In some embodiments, the counting roller may be in communication with a digital counter using a mechanical shaft or by transmitting electronic signals.

Embodiments may include both tensioned floating rollers and fixed guide rollers on the upper half and/or lower half of the tubing counter. The rollers may be "U" or "V" shaped in order to accommodate multiple diameters of coiled tubing and reduce lateral motion of the tubing while in contact with the rollers.

Embodiments of the disclosed tubing counter (111) comprise a floating roller arrangement that allows for the use of the tubing counter with multiple diameters of tubing. The upper and lower halves of the tubing counter may each contain one or multiple guide rollers (122). The tubing counter itself contains at least one tensioned floating roller (114) which is in communication with a tension assembly. In some embodiments, a tensioned floating roller (114) may be in constant communication with a tension assembly.

When in operation, coiled tubing passes between the guide rollers (122) on the upper and lower halves of the tubing counter (111). The tubing also makes contact with the tensioned floating rollers (114).

Figure 3:
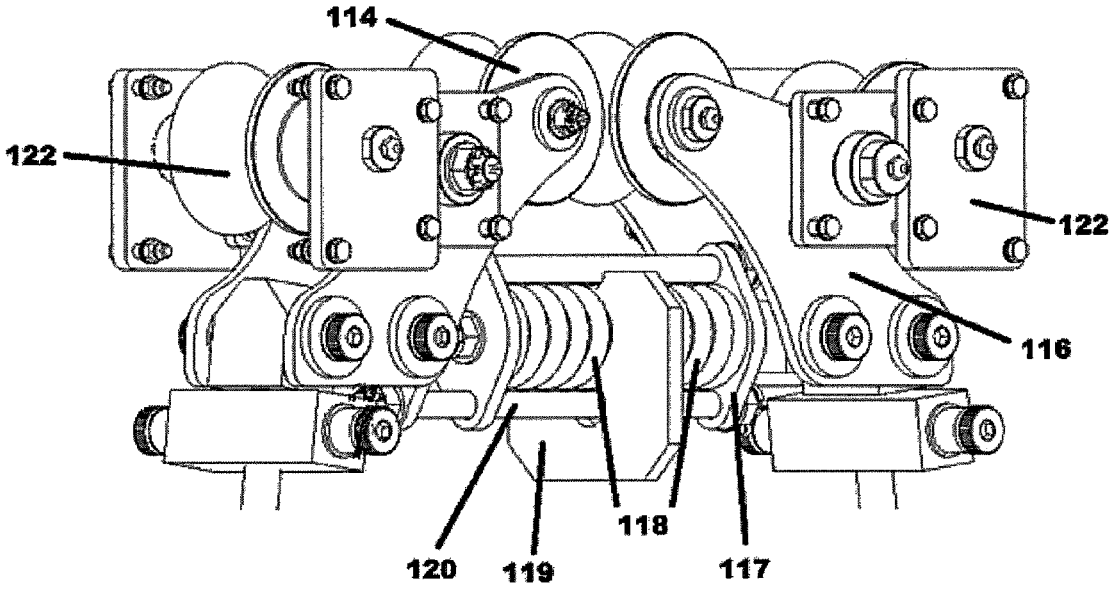
FIG. 3 shows a view of an exemplary floating roller arrangement.

FIG. 3 shows a view of the rollers of the lower half of an exemplary embodiment of the disclosed tubing counter. Referring to this exemplary embodiment, when the upper half of the tubing counter is closed, tubing is forced into contact with the tensioned floating rollers (114) on the lower half, pushing the floating rollers down. This force is transferred from the floating rollers (114) through the riser arms (116). The riser arms (116) apply a force to the transfer plates (117) which compress the springs (118) toward a fixed plate (119). The force generated by the springs (118) is transmitted through the transfer plate (117) and riser arms (116) in order to press the floating roller (114) into tensioned contact with the tubing (101) as it passes through the tubing counter (111). The components that generate and transfer tension force to the floating rollers are collectively referred to as a tension assembly.

In order to facilitate the smooth movement of the transfer plates (117), in some embodiments the transfer plates may be mounted on an upper and/or lower guide shaft (120). The guide shafts (120), facilitate travel of the transfer plate (117) and prevent any side loading effects. In some embodiments, this arrangement may translate the substantially vertical movement of the tensioned floating rollers into a substantially horizontal movement of the transfer plate, thereby allowing the springs and tensioner assembly to be arranged in a space saving design.

In some embodiments, the riser arms (116) transmit force to the transfer plate (117) at an angle, rather than directly perpendicular to the body of the transfer plate. The guide shafts serve to maintain the desired position and orientation of the transfer plate despite being acted upon by forces at various angles. In some embodiments, the transfer plate may be a substantially planar component. In other embodiments, the transfer plate may contain curved or angled surfaces configured to communicate the force of the riser arms to the springs. In some embodiments, the riser arms (116) may contain a curved or angled portion configured to communicate a force substantially perpendicularly to the transfer plate and/or substantially axially to the springs (118).

In some embodiments, the floating rollers (114) are operably connected to springs (118) without the use of riser arms (116). In such embodiments, the floating rollers may be mounted to an assembly which communicates forces generated by the springs directly to the floating rollers. In such embodiments, the floating rollers may travel in substantially the same direction as the force applied by the spring.

Figure 4:
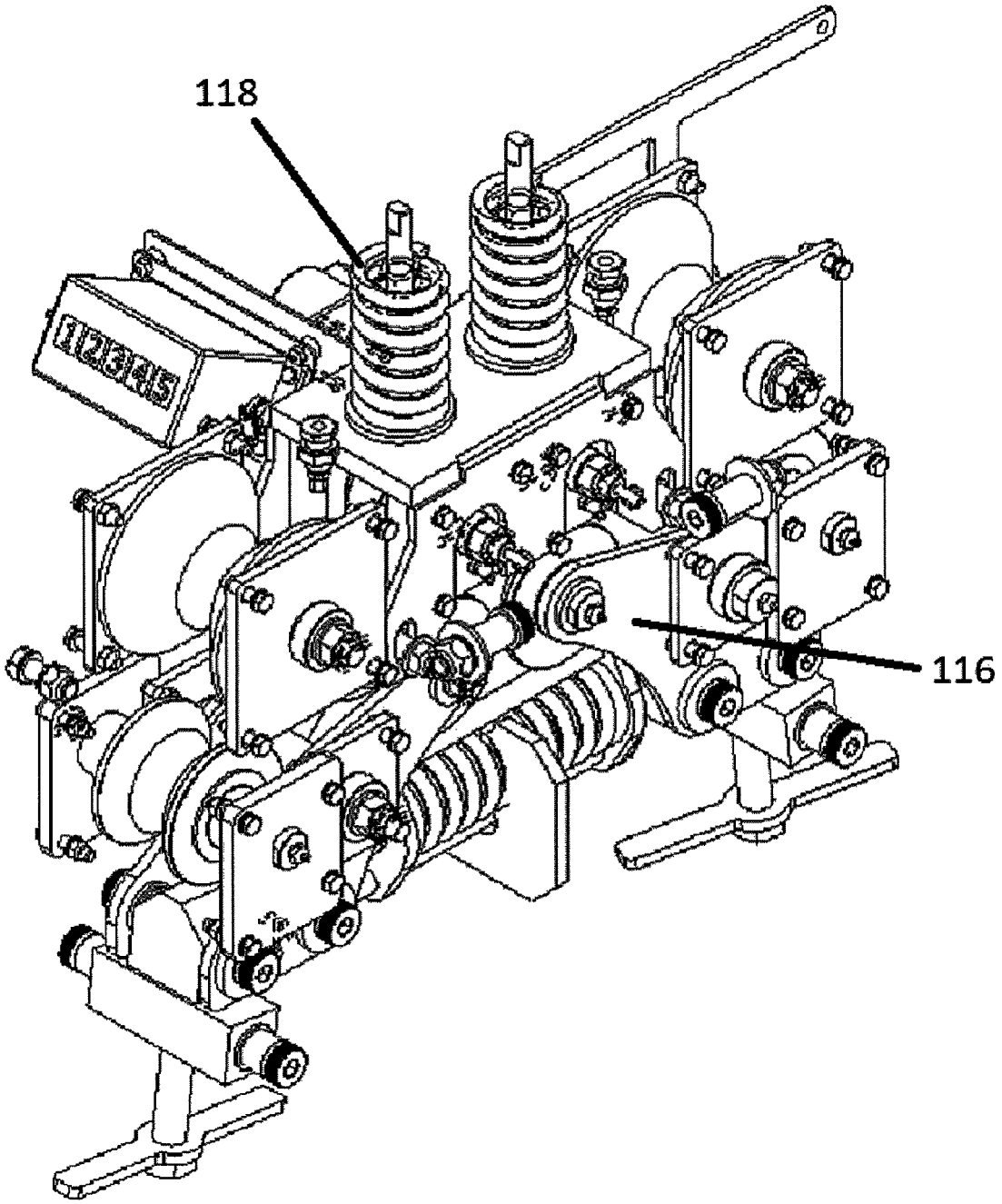
FIG. 4 shows a view of the interior of an exemplary variable sized tubing counter.

FIG. 4 shows a view of the interior of the upper and lower halves of an exemplary embodiment of the disclosed tubing counter. In this embodiment, the lower half comprises tensioned floating rollers and riser arms as described above. The upper half contains tensioned floating rollers that are pushed in a downward direction by the springs (118) directly above. In such embodiments the floating rollers on the upper half of the tubing counter do not necessarily require a riser arm or transfer plate, as the upper springs may communicate a force directly or more directly to the upper half floating rollers.

In some embodiments, floating rollers on the upper half and lower half are positioned substantially opposite each other so that the tubing is compressed between the two opposing floating rollers. Such embodiments may be designed to accommodate different diameters of coiled tubing and maintain contact between the tubing and a counting roller despite significant vibration.

In some embodiments, floating rollers on the upper and lower halves will be positioned in an offset or staggered arrangement as opposed to being positioned directly opposite from each other.

In some embodiments, two or more floating rollers are incorporated into both the upper and lower halves of the disclosed tubing counter.

In some embodiments, floating rollers are only utilized on the upper half or lower half of the disclosed tubing counter.

In some embodiments, the counting roller is a tensioned floating roller. In some embodiments, the counting roller may be a fixed roller. In such embodiments, a floating roller serves to maintain contact between a counting roller and the coiled tubing in order to facilitate an accurate reading.

Coiled tubing is generally utilized in diameters ranging from 1 to 3.25 inches. By allowing the floating rolls (114) to travel, substantially all diameters of coiled tubing may be utilized without making adjustments to the tubing counter (111). In some embodiments, the floating rollers of the upper or lower half may be configured to travel at least about 0.5 inches, or at least about 1 inch, or at least about 2 inches, or at least about 2.5, or at least about 3 inches. In some embodiments, the floating rollers of the upper or lower half may be configured to travel at most about 0.5 inches, or at most about 1 inch, or at most about 2 inches, or at most about 2.5, or at most about 3 inches. In some embodiments, the rollers within the upper half (108) may travel a different amount and/or in a different direction than the rollers on the lower half (109). In some embodiments, the rollers of the upper half (108) move angularly rather than vertically the on the rollers travel angularly in order to accommodate the insertion and/or removal of tubing.

By maintaining tension between the coiled tubing and a counting roller, the counter is able to accurately record the length of tubing that has passed through the tubing counter without the counting roller losing contact with the tubing due to vibration. By reducing or eliminating the skipping or bouncing of the tubing away from the counting roller, a more accurate determination of the length of coiled tubing that has passed through the tubing counter may be provided to the operator.

While in operation, the floating rollers (114) are under tension from the springs (118). In some embodiments, in order to unlock the upper half of the tubing counter from the lower half of the tubing counter, the springs (118) must be caged. This means the springs (118) are compressed by a caging assembly, thereby removing the tension from the floating rollers (114). Once the tension is removed from the floating rollers, there is little to no tension between the upper half and lower half of the tubing counter. At that point, the upper half may be unlocked and safely opened using the hinges.

Figure 5:
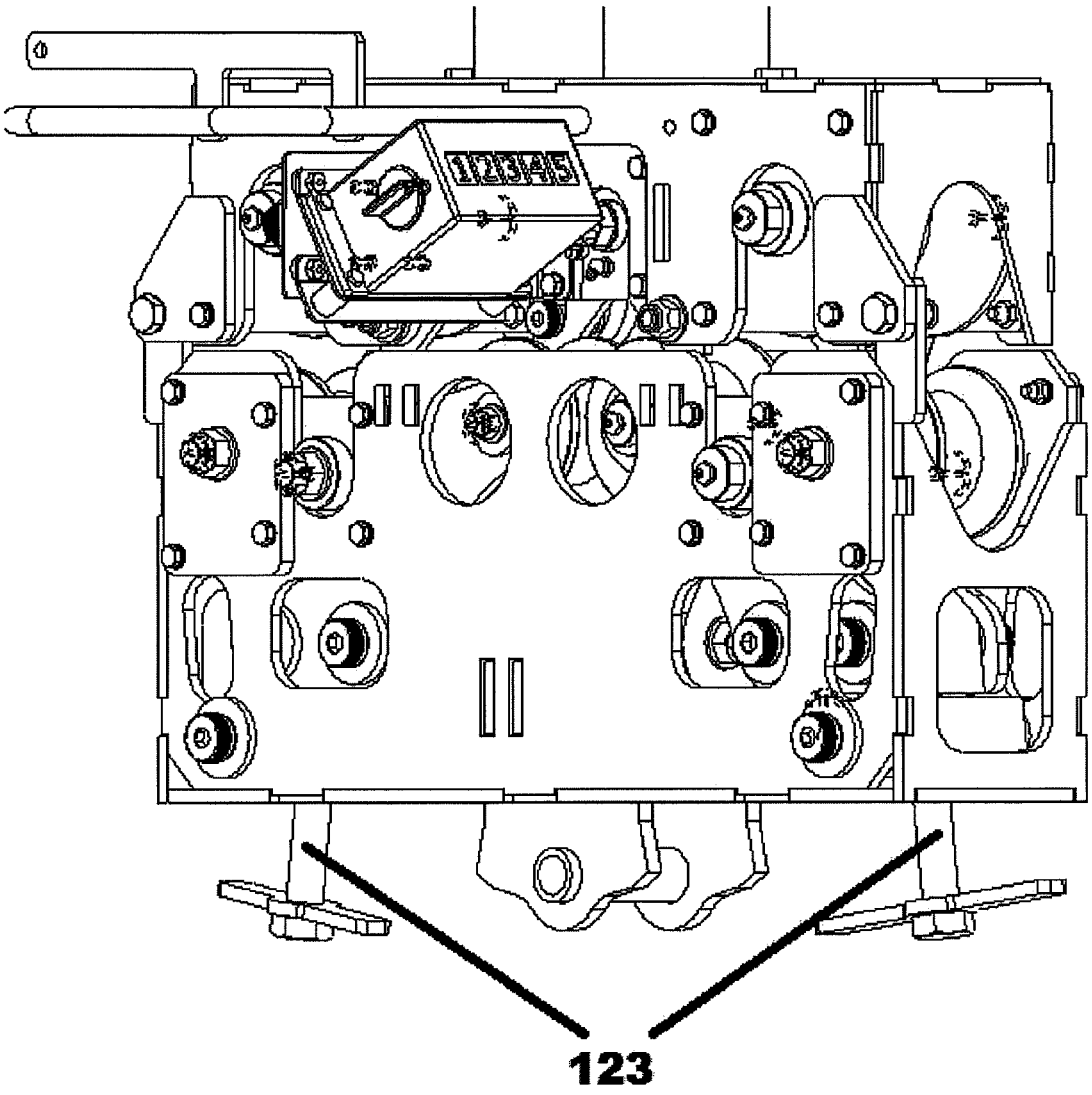
FIG. 5 shows a variable sized tubing counter with rotating caging handles.

As shown in FIG. 5, in some embodiments the caging of the springs (118) may be completed using a rotating caging handle (123). The caging handle (123) may be rotated, thereby compressing the spring (118) which removes the tensions from the floating rollers (114). This allows the upper floating rollers and/or lower floating rollers to separate and removes any tensioned force from the tubing. In some embodiments, the springs (118) of either the upper half (108) or lower half (109) may be caged together as an assembly. In some embodiments, the springs (118) of the upper half (108) may be caged separately from the springs (118) of the lower half (109). In some embodiments, the springs (118) of the upper half (108) are caged together and the springs (118) of the lower half (109) are caged independently from each other. Once tension is removed from the floating rollers, the upper half of the tubing counter may be safely unlocked from the lower half, and the tubing counter may be flipped open using the hinges. Once the tubing counter is flipped open, coiled tubing may be inserted, adjusted, changed, and/or removed.

Figure 6:
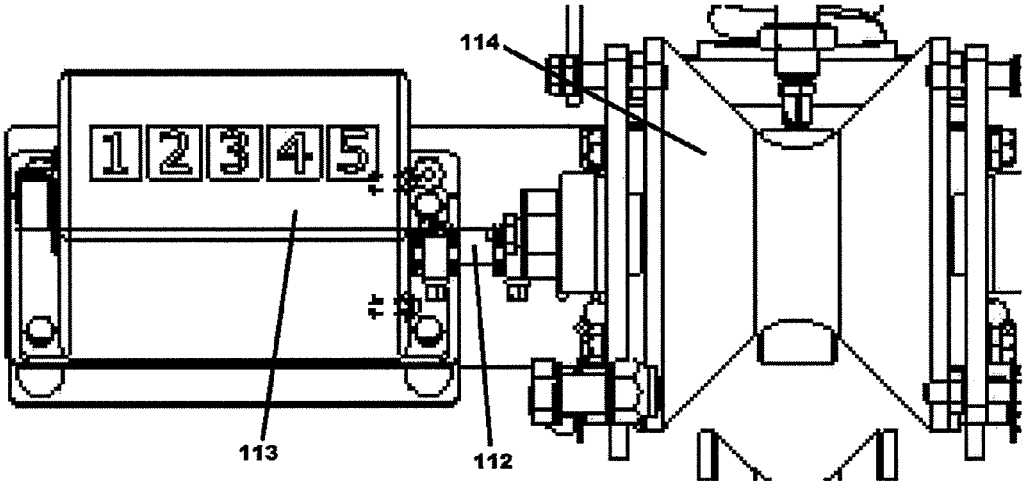
FIG. 6 shows a view of a mechanical counter and axle.

As shown in FIG. 6, certain embodiments of the disclosed tubing counter comprise a flexible axle (112) connecting a counting roller to a mechanical counter (113). In preferred embodiments, the axle (112) is sufficiently flexible to absorb vibrations and/or movement of the counting roller while being ridged enough to be rotated, directly or indirectly, by the counting roller. The axle (112) is designed to faithfully transmit the rotations of the counting roller to the mechanical counter (113). The axle may be made from any suitable material including, but not limited to rubber, plastic, and/or silicon and may include coatings of a softer, vibration absorbing material over a rigid core. In some embodiments, the axle may comprise a linkage of components configured to transmit the rotation of a counting wheel to the mechanical counter (113). In some embodiments, a linkage of multiple components may be coated in a flexible material in order to form a flexible axle that allows travel of a floating roller (114) while accurately communicating the rotation of the floating counting roller to a mechanical counter (113).

In some embodiments, the counting roller is a floating roller (114) which is configured to travel in order to maintain contact with tubing and/or allow the use of multiple diameters of tubing. As the floating counting roller travels, the angle between the mechanical counter and floating counting wheel may change substantially. In some embodiments, the axle is sufficiently flexible to accommodate this movement. In some embodiments, the rotating end of the counting roller may include spline gears or other linkage that allows the rotation of the counting wheel to be communicated to the mechanical counter over a range of angles. In some embodiments, the linkage between the mechanical counter and axle may include spline gears or other linkage that allows the rotation of the counting roller to be communicated to the mechanical counter over a range of angles.

In some embodiments, a mechanical and/or digital counter is mounted on an assembly which travels with a floating counting roller. In such embodiments, the angle between the floating counting wheel and the mechanical and/or digital counter does not substantially change. In such embodiments, a somewhat flexible axle may still be useful for absorbing vibration, but will not be required to operate over a significant range of angles.

In some embodiments, a digital counter may be operably connected directly to a floating counting roller. The digital counter may communication the rotation of the counting roller and/or length of coiled tubing that has passed through the tubing counter (111) wirelessly to a display. The display may be remote or may be in substantially the same location as the tubing counter (111) itself.

Some embodiments of the disclosed tubing counter utilize a redundant counting configuration. Multiple rollers including floating rollers and/or guide rollers may be rotationally linked to each other. Such configurations may reduce or eliminate inaccurate readings due to tubing slippage and/or any individual roller losing contact with the tubing during operation.

Figure 7:
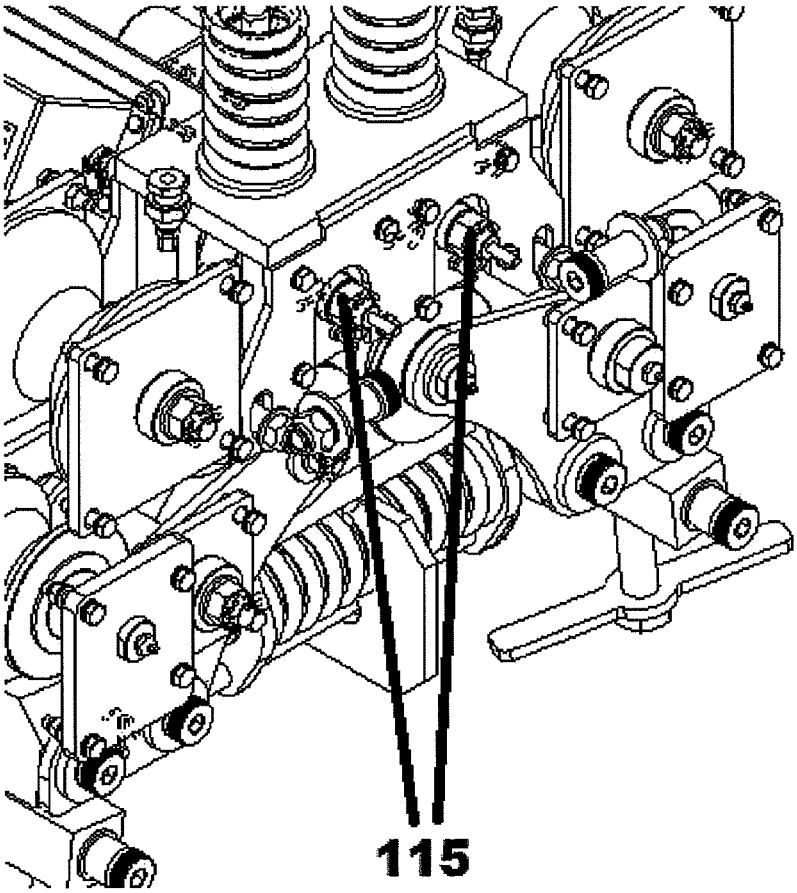
FIG. 7 illustrates rotating roller ends that may be rotationally linked.

As shown in FIG. 7, the rotating end (115) of a roller may comprise gearing, sprockets, wheels, and/or other component(s) designed to be operably connected to a chain, belt, gearing, linkage, or other component(s) for establishing a rotationally fixed relationship between two rollers.

In one exemplary embodiment, two floating rollers disposed on the upper half of the tubing counter (111) may be rotationally linked. In this example, the rotating ends (115)

of each roller comprise a rotating sprocket that is rotationally fixed to the roller. The sprockets associated with each roller may be rotationally linked using a chain. In some embodiments, a chain tensioner may be used in order to allow independent travel of one or multiple rotationally linked rollers and/or to facilitate removal and/or replacement of the chain.

In some embodiments, a rotating gear or sprocket may be disposed at a fixed location relative to a mechanical counter. That rotating sprocket may be rotationally linked to multiple other rollers, including floating rollers. In such embodiments, a substantially rigid axle may be used to communicate rotation from the fixed rotating sprocket to the mechanical counter as the fixed rotating sprocket does not travel relative to the mechanical counter.

Some disclosed embodiments relate to a coiled tubing counter comprising a housing, the housing comprising an upper half and a lower half, wherein a throughway is defined between the upper half and lower half, the throughway configured to receive a length of coiled tubing; a plurality of rollers, wherein at least one roller is a floating roller which is allowed to travel and is operably connected to a tension assembly; a mechanical counter; and a flexible axle comprising a first end and second end, the first end of the flexible axle being rotationally coupled to at least one floating roller and the second end of the flexible axle being rotationally coupled to the mechanical counter. In some embodiments, the flexible axle comprises silicone, rubber, polymers, or elastomers; the floating roller travels substantially perpendicular to the throughway, and/or at least one floating roller is configured to travel at least about 1 inch. Certain embodiments further comprise a linkage, wherein the linkage rotationally couples at least two floating rollers. In some such embodiments the linkage comprises a chain and a sprocket, and/or the rotationally linked floating rollers are disposed on the upper half of the housing. In some embodiments, the tension assembly comprises a riser arm, the riser arm operably connected to a transfer plate and the transfer plate operably connected to a spring; the transfer plate is mounted on a guide shaft, wherein the guide shaft is configured to limit the movement of the transfer plate to substantially axial movement relative to the guide shaft; at least two rollers of the plurality of rollers are floating rollers disposed on the upper half of the housing and are operably connected to a tension assembly, and wherein at least two rollers of the plurality of rollers are floating rollers disposed on the lower half of the housing and are operably connected to a tension assembly, and/or the mechanical counter is operably connected to a floating roller on the upper half of the housing and wherein the floating rollers on the lower half of the housing are configured to travel a greater distance than the floating rollers on the upper half of the housing.

Some disclosed embodiments relate to a method of counting coiled tubing, the method comprising: providing a coiled tubing counter wherein the coiled tubing counter comprises an upper half and a lower half wherein the upper and lower half are hingedly connected, and wherein a throughway is defined between the upper half and lower half, and at least one floating roller is operably connected to a counter by an axle; placing a length of coiled tubing into the throughway defined between the upper and lower half of the counter; bringing the floating roller into tensioned engagement with the coiled tubing, thereby causing the floating roller to travel; passing the coiled tubing through the throughway of the tubing counter, thereby causing the floating roller to rotate in relation to the length of coiled tubing passed through the tubing counter; and communicating the rotation of the floating roller to the counter via the axle. Some embodiments further comprise locking the upper half of the tubing counter to the lower half of the tubing counter, and/or caging a spring which is operably connected to a floating roller. In some embodiments, the caging step comprises compressing the spring, thereby operably disconnecting the spring from the floating roller.

Some disclosed embodiments relate to a coiled tubing counter comprising: a housing comprising an upper half and lower half wherein a throughway is defined between the upper half and lower half, the throughway configured to receive a length of coiled tubing; a plurality of rollers wherein at least two rollers on the upper half are floating rollers operably connected to a first tension assembly, and wherein at least two rollers on the lower half are floating rollers operably connected to a second tension assembly, the floating rollers being allowed to travel; a counter, and an axle comprising a first end and second end, the first end of the axle being rotationally coupled to at least one floating roller, and the second end of the axle being rotationally coupled to the counter. In some embodiments, the counter is a digital counter and wherein the digital counter is wirelessly connected to a display.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

We claim:

1. A coiled tubing counter comprising:

a housing comprising an upper half and a lower half, wherein a throughway is defined between the upper half and lower half, the throughway configured to receive a length of coiled tubing;

a plurality of rollers, wherein at least one roller of the plurality of rollers is a floating roller which is allowed to travel and is operably connected to a tension assembly;

a counter; and an axle comprising a first end and second end, the first end of the axle being rotationally coupled to the floating roller and the second end of the axle being rotationally coupled to the counter and wherein the axle is a flexible axle comprising silicone, rubber, polymers, elastomers or combinations thereof.

2. The tubing counter of claim 1, wherein the floating roller travels substantially perpendicular to the throughway.

3. The tubing counter of claim 1, wherein at the floating roller is configured to travel at least about 1 inch.

4. A coiled tubing counter comprising:

a housing comprising an upper half and a lower half, wherein a throughway is defined between the upper half and lower half, the throughway configured to receive a length of coiled tubing;

a plurality of rollers, wherein at least one roller of the plurality of rollers is a floating roller which is allowed to travel and is operably connected to a tension assembly;

a counter; and an axle comprising a first end and second end, the first end of the axle being rotationally coupled to the floating roller and the second end of the axle being rotationally coupled to the counter, wherein the coiled tubing counter further comprises a linkage and wherein the plurality of rollers comprises a second floating roller, wherein the linkage rotationally couples the floating roller and the second floating roller.

5. The tubing counter of claim 4, wherein the linkage comprises a chain and a sprocket.

6. The tubing counter of claim 4, wherein the rotationally linked floating rollers are disposed on the upper half of the housing.

7. A coiled tubing counter comprising:

a housing comprising an upper half and a lower half, wherein a throughway is defined between the upper half and lower half, the throughway configured to receive a length of coiled tubing;

a plurality of rollers, wherein at least one roller of the plurality of rollers is a floating roller which is allowed to travel and is operably connected to a tension assembly;

a counter; and an axle comprising a first end and second end, the first end of the axle being rotationally coupled to the floating roller and the second end of the axle being rotationally coupled to the counter, wherein the tension assembly comprises a riser arm, the riser arm operably connected to a transfer plate and the transfer plate operably connected to a spring.

8. The tubing counter of claim 7, wherein the transfer plate is mounted on a guide shaft, wherein the guide shaft is configured to limit the movement of the transfer plate to substantially axial movement relative to the guide shaft.

9. A coiled tubing counter comprising:

a housing comprising an upper half and a lower half, wherein a throughway is defined between the upper half and lower half, the throughway configured to receive a length of coiled tubing;

a plurality of rollers, wherein at least one roller of the plurality of rollers is a floating roller which is allowed to travel and is operably connected to a tension assembly;

a counter; and an axle comprising a first end and second end, the first end of the axle being rotationally coupled to the floating roller and the second end of the axle being rotationally coupled to the counter, wherein the plurality of rollers comprises a second floating roller operably connected to the tension assembly and wherein the floating roller and the second floating roller are disposed on the upper half of the housing, and wherein at least two additional rollers of the plurality of rollers are additional floating rollers disposed on the lower half of the housing and are operably connected to the tension assembly.

10. The tubing counter of claim 9, wherein the counter is a mechanical counter operably connected to the floating roller on the upper half of the housing and wherein the additional floating rollers on the lower half of the housing are configured to travel a greater distance than the floating roller and the second floating roller on the upper half of the housing.

11. A method of counting coiled tubing, the method comprising:

providing a coiled tubing counter, wherein the coiled tubing counter comprises an upper half and a lower half, wherein the upper and lower half are hingedly connected and wherein a throughway is defined between the upper half and lower half, and at least one floating roller is operably connected to a counter by an axle;

placing a length of coiled tubing into the throughway defined between the upper and lower half of the counter;

bringing the floating roller into tensioned engagement with the coiled tubing, thereby causing the floating roller to travel;

passing the coiled tubing through the throughway of the tubing counter, thereby causing the at least one floating roller to rotate in relation to the length of coiled tubing passed through the tubing counter; and communicating the rotation of the at least one floating roller to the counter via the axle and wherein the method further comprises the step of caging a spring which is operably connected to the at least one floating roller wherein the caging step comprises compressing the spring, thereby operably disconnecting the spring from the at least one floating roller.

12. The method of claim 11, further comprising the steps of locking the upper half of the tubing counter to the lower half of the tubing counter.

13. A coiled tubing counter comprising:

a housing comprising an upper half and lower half, wherein a throughway is defined between the upper half and lower half, the throughway configured to receive a length of coiled tubing;

a plurality of rollers, wherein at least two rollers on the upper half are floating rollers operably connected to a first tension assembly, and wherein the plurality of rollers comprises at least two additional rollers and wherein said at least two additional rollers are floating rollers on the lower half and are operably connected to a second tension assembly, the said at least two additional floating rollers being allowed to travel;

a counter; and an axle comprising a first end and second end, the first end of the axle being rotationally coupled to at least one floating roller and the second end of the axle being rotationally coupled to the counter.

14. The tubing counter of claim 13, wherein the counter is a digital counter and wherein the digital counter is wirelessly connected to a display.

* * * * *